United States Patent [19]

Guaraldi

[11] Patent Number: 4,572,074

[45] Date of Patent: Feb. 25, 1986

[54] MULTI-UNIT PRESS REGISTER

[75] Inventor: Glenn A. Guaraldi, Wood River Jct., R.I.

[73] Assignee: Harris Graphics Corporation, Melbourne, Fla.

[21] Appl. No.: 671,415

[22] Filed: Nov. 14, 1984

[51] Int. Cl.[4] ..... B41F 5/06; B41F 5/16

[52] U.S. Cl. ..... 101/426; 101/177; 101/181; 101/248

[58] Field of Search ..... 101/181, 248, 183, 184, 101/178, 180, 136, 137; 226/2, 3, 28, 29, 30, 31, 40, 41, 42

[56] References Cited

U.S. PATENT DOCUMENTS

| | | | |
|---|---|---|---|
| 2,863,387 | 12/1958 | Huffman . | |
| 3,641,933 | 2/1972 | Tafel . | |
| 3,701,464 | 10/1972 | Grum | 101/248 |
| 3,717,092 | 2/1973 | Crum . | |
| 3,732,815 | 5/1973 | Greiner | 101/248 X |
| 3,742,849 | 7/1973 | Greiner | 101/248 X |
| 3,742,850 | 7/1973 | Sedlak . | |
| 3,746,957 | 7/1973 | Forster | 101/248 |
| 3,945,266 | 3/1976 | Dufour et al. . | |

*Primary Examiner*—J. Reed Fisher
*Attorney, Agent, or Firm*—Yount & Tarolli

[57] ABSTRACT

A method and apparatus are disclosed for registering a perfecting offset printing unit to a reference perfecting offset printing unit while minimizing displacement between associated non-print gap areas. The circumferential position of the upper printing plate and the lower printing plate of the unit to be registered is monitored with respect to their associated blankets. The print registration between the unit to be registered and the reference unit is monitored. Printing position changes for the upper printing couple and the lower printing couple of the unit to be registered that are needed to effect registration with the reference unit are determined. A circumferential bias is determined responsive to the determined printing position changes needed and responsive to the monitored circumferential position of the upper printing plate and the lower printing plate. The upper and lower printing couples of the unit to be registered are rotated by a unit-to-unit phaser adjustment assembly and the upper printing plate and the lower printing plate are also rotated respectively by an upper and a lower circumferential adjustment assembly with respect to their associated blankets responsive to the circumferential bias and respectively responsive to the monitored printing plate positions and determined printing position changes needed for their associated printing couple. The rotation of the printing couples and the upper and lower printing plates are done simultaneously, effectuating registration between the unit and the reference unit while minimizing displacement between associated no-print gap areas.

12 Claims, 7 Drawing Figures

MULTI-UNIT PRESS REGISTER

TECHNICAL FIELD

The present invention relates to perfecting offset printing presses, and is particularly directed to a method and apparatus for registering a perfecting offset printing unit to a reference perfecting offset printing unit within a multi-unit press.

BACKGROUND ART

Multi-unit printing presses that print color images superimposed upon each other to form a complete multi-color image are known in the art. To form a clear multi-color image, it is necessary to have precise registration between the various units of the printing press.

Devices utilized to vary the phase relationship from unit-to-unit in a multi-unit press for the purpose of registration are known in the art. Also, devices utilized to circumferentially register a printing plate with its associated blanket are known in the art. None of these devices however work in cooperation with each other to register one printing unit to another printing unit while minimizing non-print gap displacement between printing plates and their associated blankets.

Partial registration can be accomplished by utilizing a unit-to-unit phaser adjustment assembly to change the printing phase of an upper and lower printing couple of one unit to that of another unit. Also, partial registration can be accomplished within each printing unit by utilizing an upper and lower circumferential adjustment assembly to rotate the upper and lower plate cylinders with respect to their associated blanket cylinders.

The printing press is made ready for a printing run by setting each of the printing units to a mechanical zero position. As a web is printed on, an operator will examine the final printed image and will adjust the press, unit-by-unit, to register the image printed by one unit to that printed by another unit until all the units are in register. As the web continues to run during the printing process, further adjustments are made by the operator. These adjustments are necessitated by variances in paper properties, the amount of ink being applied to the paper, the amount of water applied to the paper, the amount of web tension and web elasticity. As further adjustments are made by the operator, it is possible for the gap in a printing plate to be advanced or retarded beyond the gap in its associated blanket. Also, when the operator makes unit-to-unit adjustments or circumferential adjustments within a unit, he must stop the press and mechanically advance or retard the cylinders or unit drive gears.

The problem with making adjustments in narrow gap cylinders is compounded, since any circumferential movement causes an increase in non-print length.

DISCLOSURE OF THE INVENTION

In accordance with this invention, there is provided a new and improved method and apparatus for registering a perfecting offset printing unit to a reference perfecting offset printing unit while minimizing displacement between associated non-print gap areas. The new method and apparatus is designed to make large registration changes needed utilizing the unit-to-unit phaser while employing the circumferential adjustment assembly to make only the within unit changes necessary to complete the registration. A reference unit is first calibrated to an initial zero position. A unit to be registered to the reference unit is then calibrated. The position of the upper and lower printing plate in the unit to be registered is monitored. As the web is run through the units, the print registration is monitored and upper and lower circumferential changes needed to effect registration are inputted to a control device. The control device determines a circumferential bias responsive to the determined printing position change needed to effect registration and responsive to the monitored circumferential position of the upper and lower printing plates. Rotation of the printing couples of the unit to be registered and rotation of the upper and lower printing plates within the unit to be registered are made simultaneous while the press continues to run. These simultaneous rotations responsive to the determined circumferential bias and responsive to the monitored printing plate positions and the determined printing position changes needed effects registration of the one unit to the reference unit.

The method for registering a perfecting offset printing unit to a reference offset printing unit while minimizing displacement between associated non-print gap areas in which both printing units act in succession on a web and each unit has an upper printing plate disposed around an upper printing cylinder and an upper blanket disposed around an upper blanket cylinder, such combination defining an upper printing couple and each unit has a lower printing plate disposed around a lower print cylinder and a lower blanket disposed around a lower blanket cylinder, such combination defining a lower printing couple, the method includes the steps of monitoring the circumferential position of the upper printing plate and the lower printing plate of the unit with respect to their associated blanket. Another step is monitoring print registration between the unit and the reference unit. Another step is determining a printing position change needed for each printing couple of the unit to effect registration with the reference unit. The circumferential bias is determined responsive to the determined printing position change needed and responsive to the monitored circumferential position of the upper printing plate and the lower printing plate. The upper and lower printing couples of the unit are then rotated responsive to the determined circumferential bias and the upper printing plate and the lower printing plate of the unit are rotated both responsive to the determined circumferential bias and respectively responsive to the monitored printing plate position and the determined printing position change needed for its associated printing couple, the rotations effectuating registration between the two units.

The apparatus for registering a perfecting offset printing unit to a reference perfecting offset printing unit while minimizing displacement between associated non-print gap areas, both printing units acting in succession on a web and each unit having an upper printing plate disposed around an upper print cylinder and an upper blanket disposed around an upper blanket cylinder, such combination defining an upper printing couple and each unit having a lower printing plate disposed around a lower print cylinder and a lower blanket disposed around a lower blanket cylinder, such combination defining a lower printing couple, the apparatus includes a unit-to-unit phaser adjustment means operatively connected to the unit for circumferentially adjusting the upper and lower printing couple of the unit with respect to the reference unit. The apparatus further includes an upper circumferential adjustment means operatively connected to the upper plate of the unit for circumferentially adjusting the position thereof and a lower circumferential adjustment means operatively connected to the lower plate of the unit for circumferentially adjusting the position thereof. A first monitoring means is provided for monitoring the circumferential position $U_1$ of the upper printing plate with respect to the upper blanket and the circumferential position $L_1$ of the lower printing plate of the unit with respect to the lower blanket, and a second monitoring means is provided for monitoring registration between the unit and the reference unit. Determining means is provided for determining a printing change $\Delta U$ needed for the upper printing couple of the unit and a printing change $\Delta L$ needed for the lower printing couple of the unit to effect registration with the reference unit. A control means is provided operatively connected to the unit-to-unit phaser adjustment means, the upper circumferential adjustment means and the lower circumferential adjustment means for determining a circumferential bias B responsive to the determining means and the first monitoring means, the unit-to-unit phaser adjustment means rotating the upper and lower printing couples of the unit responsive to the determined bias B and the upper and lower circumferential adjustment means respectively rotating the upper and lower print plates responsive to the bias B and respectively responsive to the monitored circumferential position of the upper printing plate and the lower printing plate and respectively responsive to $\Delta U$ and $\Delta L$.

In the preferred embodiment, the circumferential displacement $U_1$ of the upper printing plate of the unit with respect to its associated upper blanket is determined. The circumferential displacement $L_1$ of the lower printing plate of the unit with respect to its associated lower blanket is determined. The print registration between the unit and the reference unit is monitored and a $\Delta U$ and a $\Delta L$ changes needed to effect registration of the unit with the reference unit are determined where $\Delta U$ is the amount of shift needed to register the upper printing couple of the unit with the upper printing couple of the reference unit and where $\Delta L$ is the amount of shift needed to register the bottom printing couple of the unit with the bottom printing couple of the reference unit. The circumferential bias B is determined according to the equations:

When $|U_1+\Delta U| \leqq |L_1+\Delta L|$,

Then $B=U_1+\Delta U+k$, and

When $|U_1+\Delta U| > |L_1+\Delta L|$,

Then $B=L_1+\Delta L-k$,

The upper printing couple and the lower printing couple are rotated utilizing the unit-to-unit phaser adjustment assembly by an amount sufficient to effect a circumferential displacement from the reference unit equal to the bias B. The upper plate of the unit is rotated by an amount $U_2$ sufficient to effect the circumferential displacement equal to $U_1+\Delta U-B$. The lower plate of the unit is rotated by an amount $L_2$ sufficient to effect a circumferential displacement equal to $L_1+\Delta L-B$. When $k=0$, either $U_2$ or $L_2$, above, will be equal to zero. Under such condition, one circumferential adjustment assembly remains unchanged while the other circumferential adjustment assembly and the unit-to-unit phaser make the required register change.

Another feature of the present invention is the provision of adding or subtracting a value k equal to $(L_1+\Delta L-U_1-\Delta U)/2$ to the bias equation for determining B. Adding or subtracting k provides that misregistration within a unit is equally shared by the upper and lower printing plates, hence reducing blanket gap to plate gap misalignment by one half.

Still yet another feature of the present invention is a provision for updating the value of $U_1$ and $L_1$ after a circumferential adjustment since the upper printing plate and the lower printing plate will have been rotated, the updated valves $U_1$ and $L_1$ are determined according the equations $U_1=2U_1+\Delta U-B$ and $L_1=2L_1+\Delta L-B$.

Other features and advantages and a fuller understanding of the invention will be had from the following detailed description and the accompanying drawings.

BEST MODE FOR CARRYING OUT THE INVENTION

Figure 1:
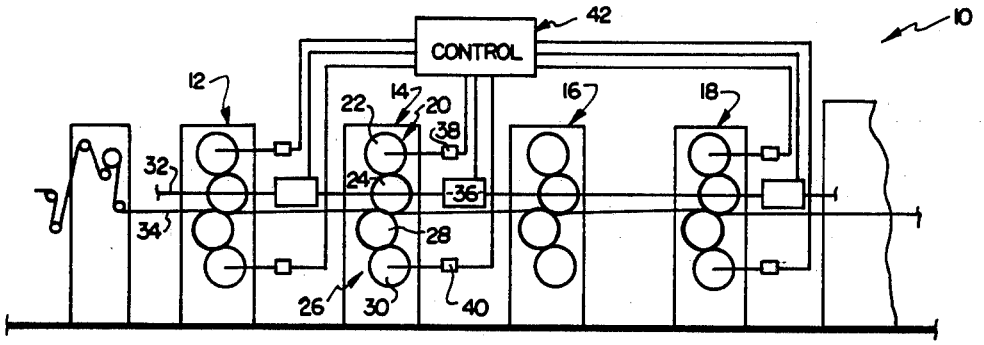
FIG. 1 is a schematical representation of a four color perfecting offset printing press embodying the present invention.

A description of the invention follows referring to the drawings in which like reference numerals denote like elements of structure in each of the several figures.

Referring now to FIG. 1, the printing press 10 is shown for printing four colors having individual printing units including a first printing unit 12, a second printing unit 14, a third printing unit 16, and a fourth printing unit 18. Each printing unit includes an upper printing couple 20 having an upper printing plate disposed around an upper printing cylinder 22 and an upper blanket disposed around an upper blanket cylinder 24. Each unit also includes a lower printing couple 26 having a lower blanket disposed around a lower blanket cylinder 28 and a lower printing plate disposed around a lower printing cylinder 30.

A common drive shaft 32 having an axis of rotation 33 is operatively connected to each upper blanket cylinder of each printing unit and is adapted to drive the upper and lower printing couples in each printing unit. A web 34 is fed into the printing press 10 and is acted on in succession by the upper and lower printing couples of each printing unit. Those skilled in the art will appreciate the necessity of having each printing unit registered to the other printing units in the printing press 10 to produce a correct resulting image on both sides of the web. One of the units in the printing press is designated as a reference unit which is printing unit 16 of FIG. 1. Printing unit 16 is calibrated into a make-ready condition, meaning that the upper and lower blanket gaps align and the upper and lower printing plate gaps align with their associated blanket gaps. All other units in the printing press 10 include a unit-to-unit phaser adjustment assembly 36 operatively connected to the upper blanket cylinder 24, an upper circumferential adjustment assembly 38 operatively connected to the upper printing cylinder 22 in a printing unit and a lower circumferential adjustment assembly 40 operatively connected to the lower printing cylinder 30 of the printing unit. A control 42 is provided and is operatively connected to each unit-to-unit phaser adjustment assembly, upper circumferential adjustment assembly and lower circumferential adjustment assembly for the three printing units 12, 14 and 18 of in the printing press 10.

As the web 34 proceeds through the printing press 10, print registration is monitored either by an operator or by means of electronic sensing devices. If the printing press 10 is in complete registration, meaning that all the printing units are registered, changes in humidity, elastic properties of the web, amount of ink applied to the printing units, the amounts of water applied, amount of web tension and web elasticity can cause the printing between units to become misregistered. Changes needed to register a particular printing unit to the other printing units is inputted to the control 42 such as a computer. The control 42 will control the unit-to-unit phaser adjustment assembly and the upper and lower circumferential adjustment assemblies in a misregistered unit to effectuate registration.

Figure 2:
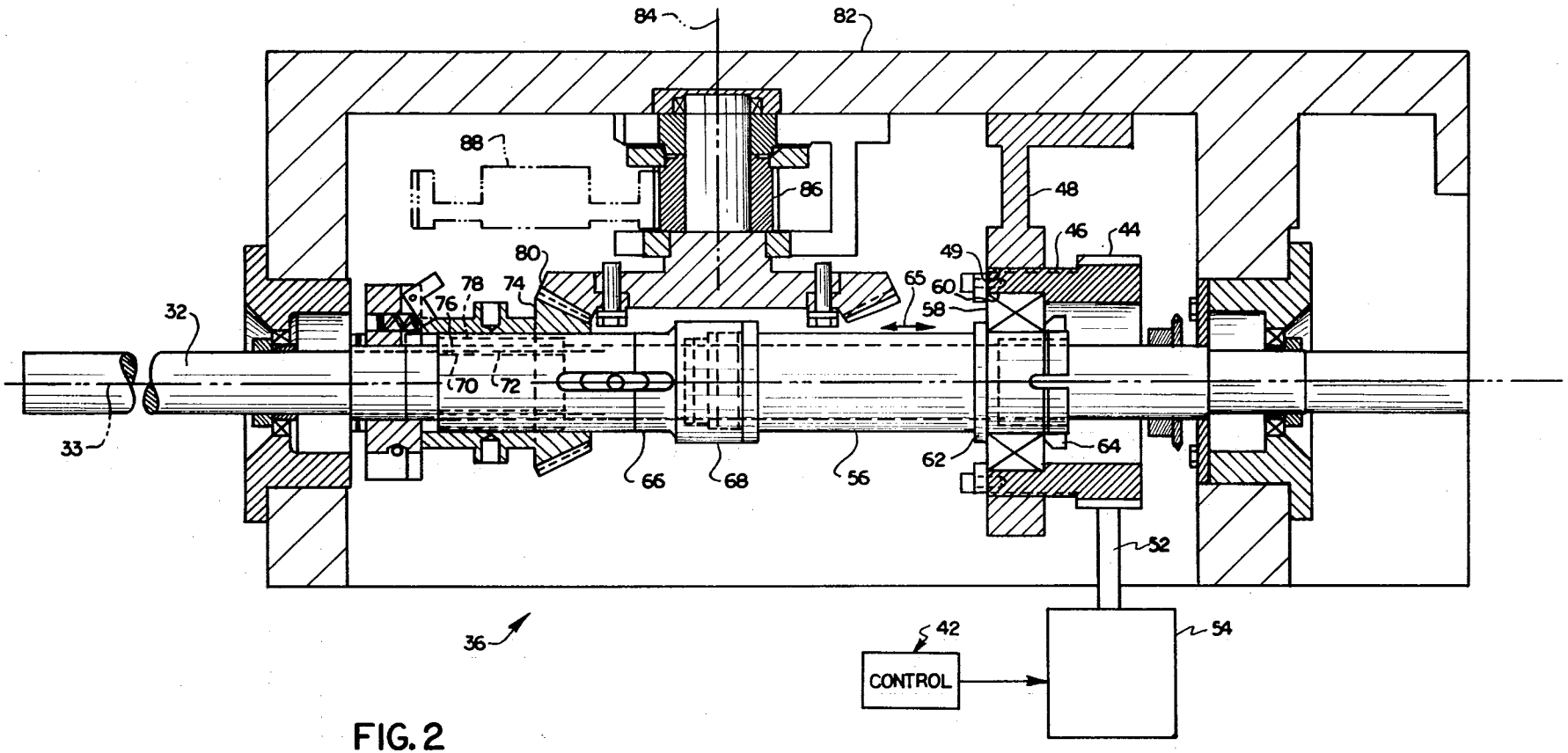
FIG. 2 is a top plan view of a unit-to-unit phaser adjustment assembly partially in fragmentary for one of the printing units.
Figure 3:
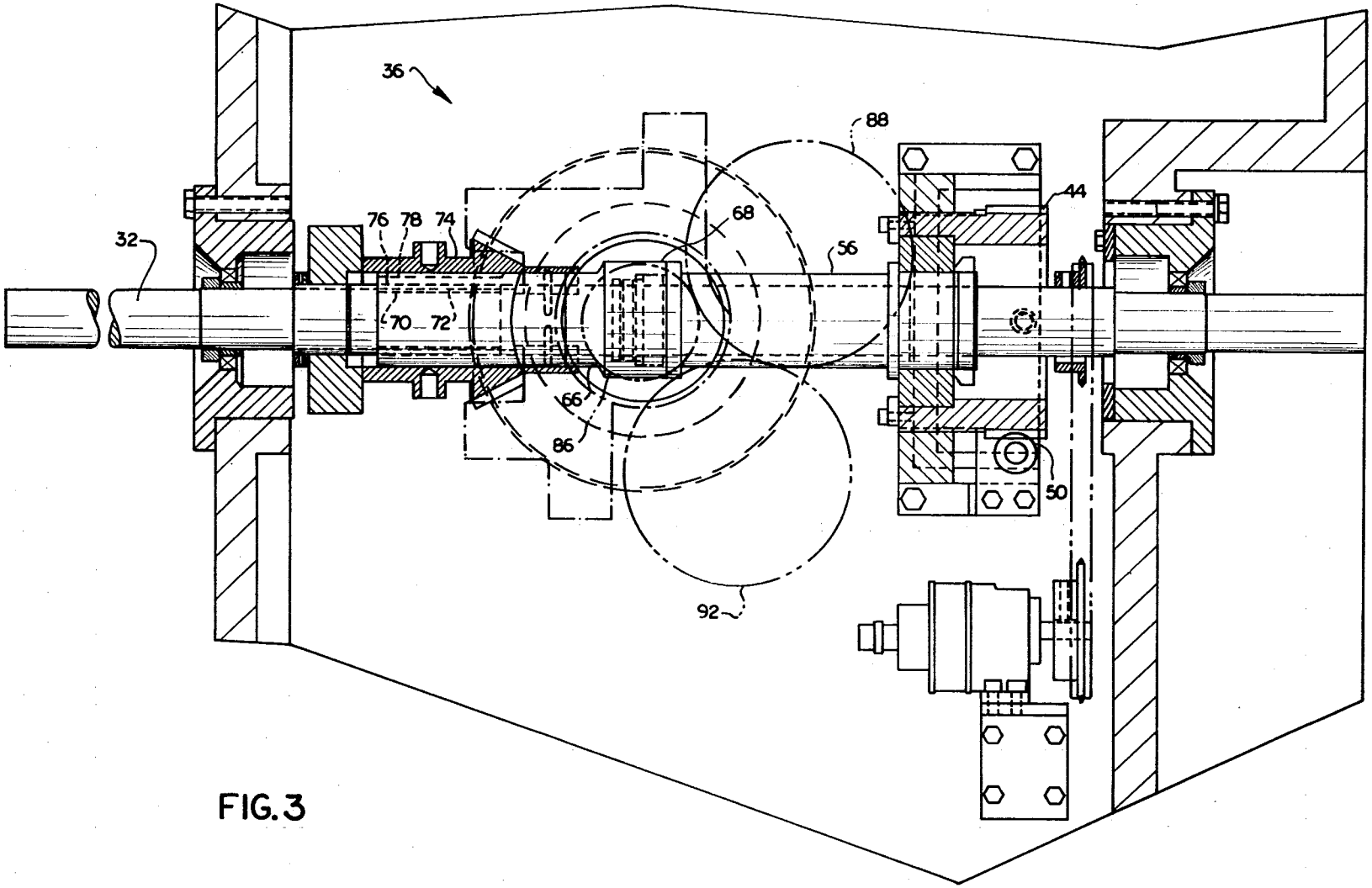
FIG. 3 is a side elevational view partially in fragmentary showing the unit-to-unit phaser adjustment assembly as viewed from the gear side of FIG. 2 with some parts removed for clarity.
Figure 4:
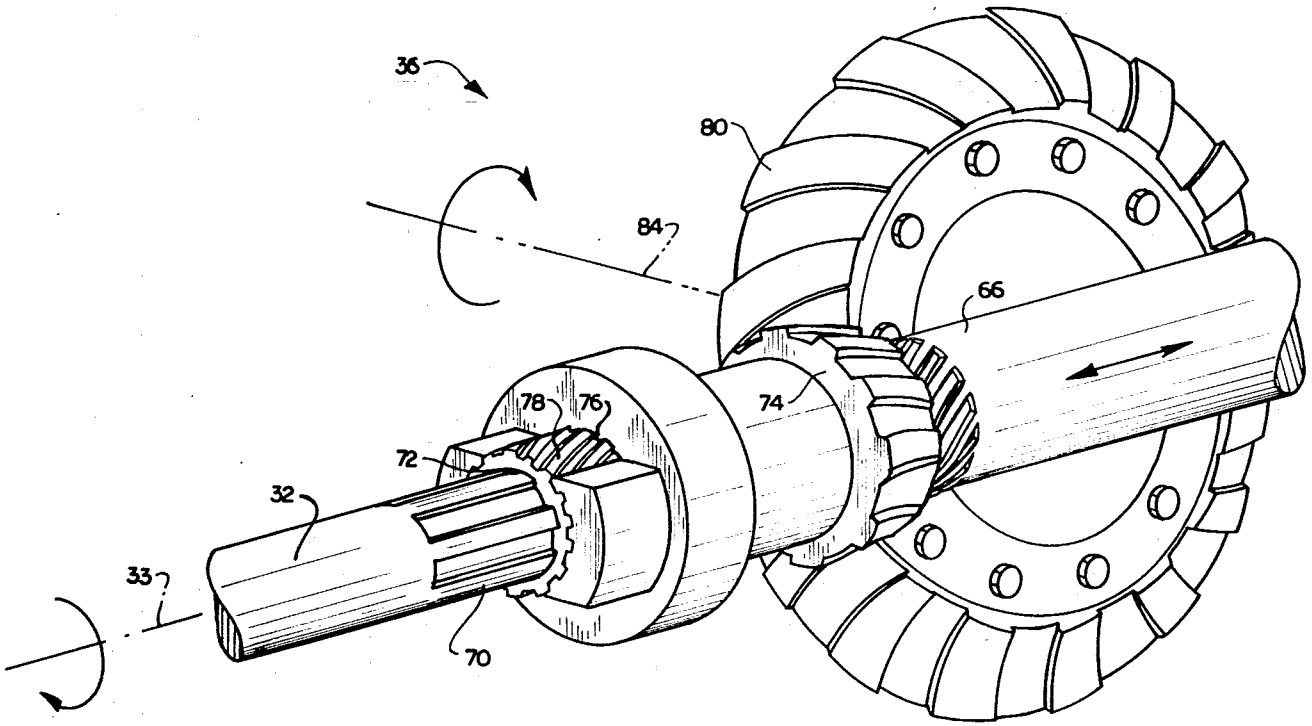
FIG. 4 is an enlarged exploded isometric view of a portion of the unit-to-unit phaser assembly of FIGS. 2 and 3.

Referring now to FIGS. 2, 3 and 4, a unit-to-unit phaser adjustment assembly 36 is shown. The unit-to-unit phaser adjustment assembly for each unit is similar in structure. Therefore, for simplicity, only one such unit will be described in detail. A helical gear 44 having an externally threaded, projecting sleeve portion 46 encircles drive shaft 32 concentric with the drive shaft axis 33 and is threaded in a fixed mounting bracket 48 having a cooperatively threaded receiving bore 49. A worm gear 50 projects from a motor shaft 52 rotatably mounted to a motor 54. Worm gear 50 is drivingly meshed with helical gear 44. The control 42 is operatively connected to the motor 54 for control thereof. The motor 54 is a dual direction motor so that shaft 52 can rotate in either direction. As the shaft 52 rotates, worm gear 50 drives the helical gear 44. The threaded engagement between the threaded projecting sleeve portion 46 and the fixed mounting bracket 48 causes the helical gear with its threaded projecting sleeve portion to move longitudinally along the drive shaft 32 in either direction depending on the direction of rotation of the shaft 52.

A drive tube 56 is mounted coaxial with the drive shaft 32. A thrust bearing 58 is disposed between an interior recess portion 60 of the threaded projecting sleeve portion 46 and radially projecting collar portions 62, 64 of the drive tube 56. As worm gear 50 drives the helical gear 44 longitudinally with respect to the drive shaft 32 axis, the drive tube 56 moves longitudinally along the drive shaft 32 in the directions of arrow 65.

A second drive tube 66 is coupled to the drive tube 56 by means of a coupling 68. The second drive tube 66 is mounted coaxially with the drive shaft 32. Drive shaft 32 has longitudinally straight splines 70 that mate with internal straight splines 72 of the second drive tube 66. Those skilled in the art will appreciate that the second drive tube 66 can slide longitudinally along the drive shaft 32 because of the straight spline arrangement 70, 72. Rotational motion of the drive shaft 32 will cause rotational motion of the second drive shaft 66 and in turn rotational motion of the drive tube 56. Rotational motion of the drive shaft 56 will not affect the drive gear 44 because of the thrust bearing 58.

A bevel gear 74 having internal helical splines 76 is radially disposed around second drive tube 66 and mesh with helically projecting splines 78 of the second drive tube 66. The bevel gear 74 is longitudinally fixed at both ends in a suitable fashion with respect to the drive shaft 32. As the second drive tube 66 is longitudinally driven with respect to the drive shaft 32, the helically projecting splines 78 cam against the internal helical splines 76 of the bevel gear 74. The camming action between the helical gears causes rotational motion of the bevel gear 74. It will be appreciated that the particular gear arrangement between the drive shaft 32, the second drive tube 66 and the bevel gear 74 also couples the bevel gear 74 to the drive shaft 32 such that rotational motion of the drive shaft 32 also rotates the bevel gear 74. Therefore, the bevel gear 74 can be rotated either by rotation of the drive shaft 32 or longitudinal motion of the second drive tube 66. Since the second drive tube 66 can move longitudinally in either direction, the bevel gear 74 can be rotated also in either direction in cooperation with the longitudinal motion of the second drive tube 66.

Bevel gear 74 is meshed with a spiral bevel gear 80. Spiral gear 80 is rotatably fixed to a frame 82 for rotation about an axis 84. The spiral gear 80 has a drive gear 86 fixed thereto and rotatable about the axis 84. The drive gear 86 is meshed with the drive gear 88 for the upper blanket cylinder 24 for the associated printing unit.

Figure 6:
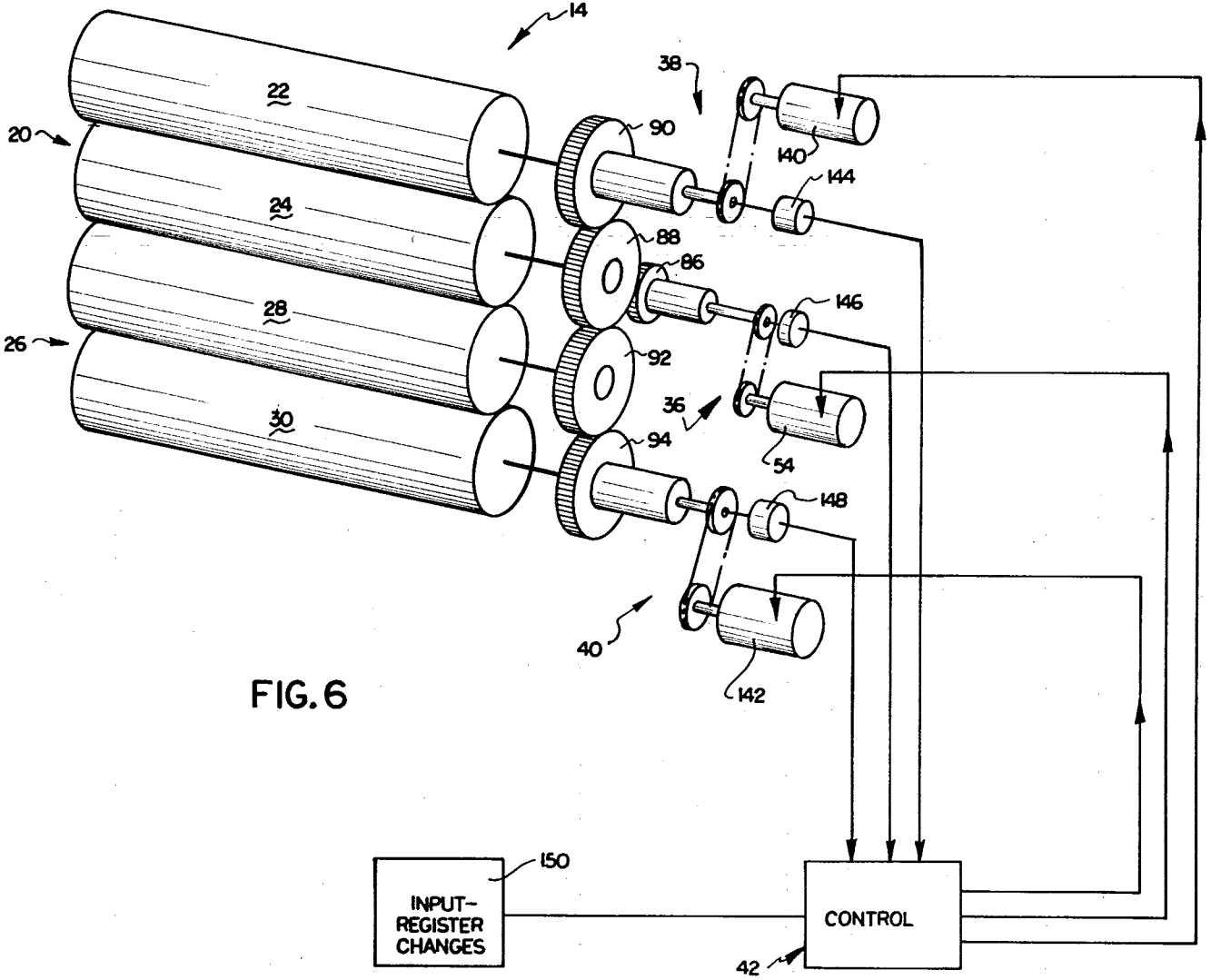
FIG. 6 is a schematical representation of a printing unit having a unit-to-unit phaser assembly and an upper and lower circumferential adjustment assembly.

Referring to FIG. 6, drive gear 88 of the upper blanket cylinder 24 is geared to the drive gear 90 for the upper plate cylinder 22 and to the drive gear 92 for the lower blanket cylinder 28. Drive gear 92 is geared with a drive gear 94 for the lower plate cylinder 30. Rotation of the drive gear 88 causes simultaneous rotation of the drive gears 90, 92 and 94, and, in turn rotation of the cylinders 22, 24, 28 and 30. It will be appreciated that rotation of the drive shaft 32 will drive all of the cylinders in a printing unit. The unit-to-unit phaser adjustment assembly 36 can be utilized through control 42 to change the phase of a printing unit with respect to another printing unit by rotating all the cylinders in the unit being adjusted without causing rotation of the drive shaft 32.

Assuming that a print unit 16 is an initial reference print unit, i.e., the blanket and print cylinders are mechanically set to a zero position with all the printing plate and blanket gaps aligned. Another printing unit can be adjusted with respect to the reference unit by utilizing the unit-to-unit phaser adjustment assembly 36.

Figure 5:
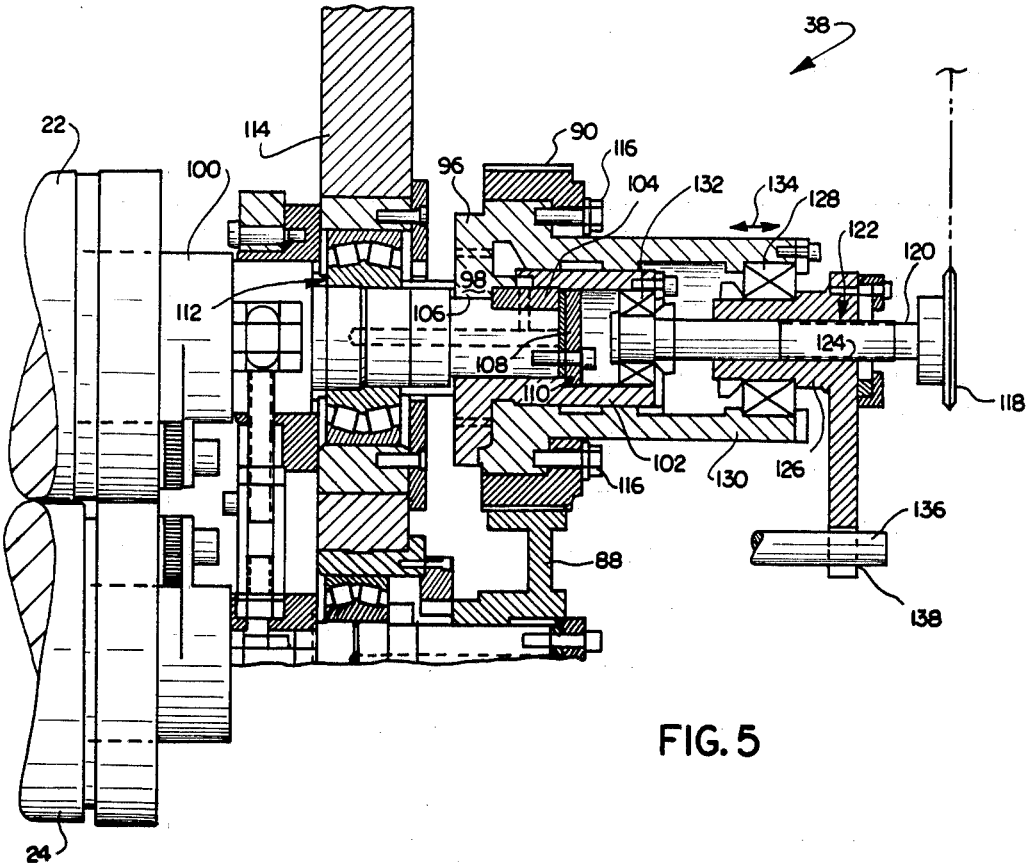
FIG. 5 is a sectional view of a circumferential adjustment assembly of one of the printing units with some parts removed for clarity.

Referring now to FIG. 5, the operation of a circumferential adjustment assembly for a given printing unit will be appreciated. The circumferential adjustment assemblies for each printing unit is similar in structure. Therefore, for simiplicity, only one such unit will be discussed in detail. An upper circumferential adjustment assembly 38 is shown with the drive gear 88 meshed with the drive gear 90. A circumferential adjustment assembly is described in U.S. Pat. No. 3,945,266 to Dufour et al., which is assigned to the assignee of this application, and is fully incorporated herein by reference. The upper circumferential adjustment assembly 38 includes a pair of helical gears 96, 98 mounted coaxially with the upper printing plate cylinder 22. The helical gear 98 is fixedly mounted on a spindle 100 of the upper printing cylinder 22 so as to rotate with the cylinder 22. The helical gear 98 has helical gear teeth mounted on the left end thereof which mesh with the helical gear teeth of the gear 96. Gear 98 also has a projecting sleeve portion 102 which is keyed by a suitable key 104 for rotation with the spindle 100. In addition, the gear 98 is fixed against axial movement of the spindle 100 between a shoulder 106 on the spindle and a cap 108 suitably secured to the end of the spindle 100 and which also engages an internal shoulder 110 of the gear sleeve portion 102. A slight gap can exist between the cap 108 and the end of the spindle 100 in order that the gear 98 be securely held in position.

The spindle 100 of the cylinder is supported for rotation in a suitable bearing arrangement 112 in a housing member 114. The left side of the cylinder 22 has a spindle and bearing mounting (not shown) to support the other end of cylinder 22 for rotation about a central axis.

The cylinder 22 is driven for the purposes of printing through the main drive gear 90 which is suitably secured to the gear member 96 by means of a plurality of bolts 116. The drive to the cylinder 22 during printing is through the gear 90, the meshing helical teeth of gears 96, 98, through the key 104, to the spindle 100. The outer peripheral gear teeth on the gear 90 are spur gear teeth, that is, the gear teeth extend parallel to the axis of rotation of the gear.

Circumferential adjustment of the cylinder 22 occurs upon relative axial movement of the gears 96, 98. Upon this relative axial movement, the meshing helical teeth of the gears 96, 98, cause the camming action to occur which results in circumferential movement of the cylinder 22. The gear 96 is moved axially relative to the gear 98 to effect this camming action. When this axial movement of the gear 96 occurs, the gear 90 likewise is moved axially, but since the teeth thereon are spur gear teeth, the gear 90 is free to move axially relative to its meshing drive gear 88. Also, due to the meshing engagement of the teeth of the gear 90 with its meshing gear 88 and the resistance which this creates to rotation of the gear 96. Upon axial movement of the gear 96, a gear 98 will be cammed and rotate.

The gear 96 is moved axially for the purpose of circumferential adjustment of the cylinder 22 by energization of a motor, FIG. 6. The motor is coupled through a drive chain (not shown) to a spindle 118. Spindle 118 is connected to a drive shaft 120. The drive shaft 120 is threadedly engaged at 122 in a threaded bore 124 in a bracket member 126. The bracket member 126, in turn, has a bearing 128 interposed between the outer periphery of the bracket 126 and a projecting sleeve portion 130 of the gear 96. The bearing 128 is trapped against axial movement relative to the bracket 126, as well as trapped against axial movement relative to the sleeve portion 130 of the gear 96. This trapping is effective by means of suitable shoulders, a cap and a retaining ring.

The leftwardmost end of the shaft 120 is supported by a bearing 132 which is located intermediate the sleeve portion 102 of the helical gear 98 and the outer end of the drive shaft 120. Again, the bearing 132 is suitably supported so as not to move axially relative to either the drive shaft 120 or the sleeve portion 102 of the gear 98.

Accordingly, upon energization of the motor, the drive shaft 120 is rotated. The drive shaft 120 cannot move axially due to the fact that the drive shaft 120 is fixed at its left end, in effect, to the cylinder 22 which holds it from axial movement. However, due to the threaded engagement between the drive shaft 120 and the bracket member 126, the bracket member 126 will move axially relative to the drive shaft 120 in a direction indicated by arrows 134. The bracket member 126, when it is moved axially, forces the gear 96, axially relative to the gear 98, and as the gear 96 moves axially relative to the gear 96, the aforementioned camming action between the gear teeth of the gears 96, 98 occurs and the cylinder 22 is moved circumferentially. A rod 136 is provided which extends through an opening 138 of the bracket member 126, and the rod 136 guides the axial movement of these parts and prevents rotation of the bracket 126 about the drive shaft 120.

Figure 7:
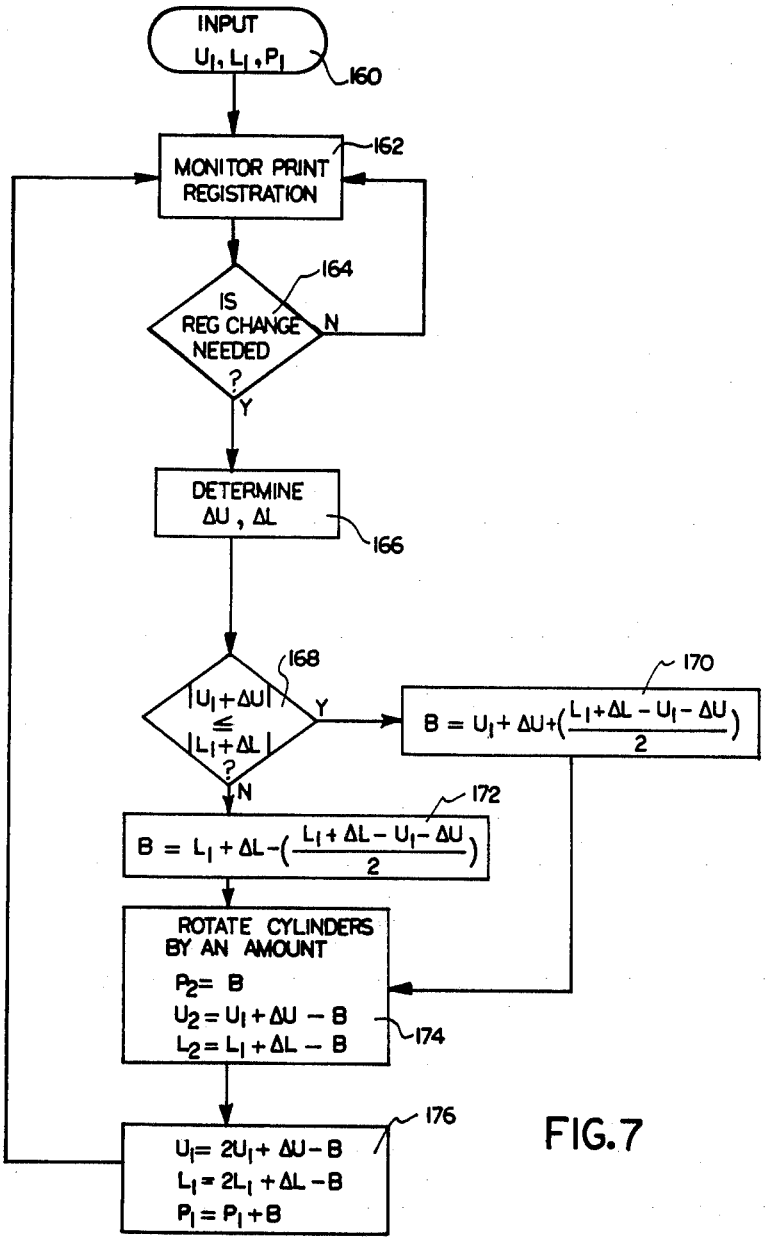
FIG. 7 is a flow diagram of the logic steps involved in registering one unit to a reference unit in accordance with the present invention.

Referring now to FIGS. 6 and 7, the present invention will be appreciated. The unit-to-unit phaser adjustment of a print unit to a reference unit and in the upper and lower circumferential adjustments within a unit are similar for each of the print units. Therefore, for simplicity, only the adjustment of one printing unit 14 to reference printing unit 16 will be discussed. Control unit 42 is operatively connected to the motor 54 of the unit-to-unit phaser adjustment assembly 36. The control 42 is also operatively connected to a motor 140 of the upper circumferential adjustment assembly 38 and to a motor 142 of the lower circumferential adjustment assembly 40. A potentiometer 144 is operatively connected to the upper printing cylinder 22 and is utilized to monitor rotational position of the upper printing cylinder 22 and in turn the upper printing plate disposed therearound. Likewise, a potentiometer 146 is operatively connected to the upper blanket cylinder 24 and is utilized to monitor the rotational phase position of the printing unit 14. A potentiometer 148 is operatively connected to the lower printing cylinder 30 and is utilized to monitor the rotational position of the lower printing cylinder 30 and in turn the lower printing plate disposed therearound. The potentiometers 144, 146 and 148 are operatively connected to the control 42.

The drive shaft 32 is not shown in FIG. 6, but it will be appreciated, as described above, that the drive shaft 32 drives the print unit 14 through driving gear 86. The unit-to-unit phaser adjustment 36 is utilized to adjust the phase of the print unit 14 to a reference printing unit 16. The upper circumferential adjustment assembly 38 is utilized to adjust the circumferential displacement between the upper printing plate and the upper blanket. The lower circumferential adjustment assembly 40 is utilized to adjust the relative circumferential position of the lower printing plate to the lower blanket. As a web 34 is run through the printing press 10, the print registration of the top and bottom are monitored either by means of an operator or by other means such as utilization of electronic eyes.

Assume that after the press has been running for a time in registration, it is determined that printing unit 14 is no longer registered to the reference printing unit 16. The top of the web and the bottom of the web are monitored to determine upper circumferential displacement needed to register the upper printing couple 22, 24 with the printing unit 16. Also, the circumferential displacement needed to register the lower printing couple 28, 30 is determined to effect registration with the printing unit 16. Input register changes needed 150 are inputted to the controller 42. The controller 42 will automatically adjust the unit-to-unit phaser adjustment assembly and both the upper and lower circumferential adjustment assemblies to effect registration with the unit 16.

Referring to FIG. 7, a flow chart is shown of the logic steps made by the controller 42 to register the printing unit 14 with the reference printing unit 16. Each of the printing units are registered according to the same method. For simplicity, only registration of printing unit 14 is described in detail. When the gap of a printing plate and the gap of its associated blanket align exactly, this is defined as zero circumferential displacement. Any circumferential displacement between the gaps in the upper printing plate and its associated upper blanket is defined as $U_1$. Likewise, any displacement between the gaps of the lower printing plate and its associated lower blanket is defined as $L_1$.

The upper blanket and lower blankets are set such that their gaps align with each other. The point of contact on web 34 of the upper and lower blanket gaps of the printing unit 14 and the point of contact on web 34 of the upper and lower blanket gaps of the reference unit 16 may have an amount of offset defined as $P_1$. If the point of contact of the blanket gaps for the two units coincide, $P_1$ would equal zero.

The initial $U_1$, $L_1$ and $P_1$ of printing unit 14 are inputted in step 160 to the controller 42. Step 162 monitors the print registration between the printing unit 14 and the reference printing unit 16. In step 164, the determination is made whether or not the units are still in registration based on the monitoring of step 164, i.e., the image printed by the printing unit 14 exactly coincides with the printing image printed by the printing unit 16 on the web 34. If no registration change is needed, step 162 is returned to and monitoring of the print registration continues. If a registration change is needed, step 166 determines the amount $\Delta U$ of circumferential change needed to register the upper printing couple of the printing unit 14 with the upper printing couple of the reference printing unit 16. Likewise, an amount $\Delta L$ of circumferential change needed to register the lower printing couple on the printing unit 14 with the lower printing couple on the reference printing unit is determined. Step 168 determines if the absolute value of $U_1+\Delta U$ is less than or equal to the absolute value of $L_1+\Delta L$. A bias B is calculated depending on the results of step 168. If the result of step 168 is yes, then, a bias B is determined in step 170 to equal $B=U_1+\Delta U$ plus $(L_1+\Delta L-U_1-\Delta U)/2$. If the result of step 168 is no, then, the bias B determined in step 172 according to the equation $B=L_1+\Delta L-(L_1+\Delta L-U_1-\Delta U)/2$.

After the bias B is determined in step 170 or 172, the unit-to-unit phaser adjustment assembly 36, the upper circumferential adjustment assembly 38 and the lower circumferential adjustment assembly 40 rotates the cylinders in step 174 responsive to the equations provided therein. The unit-to-unit phaser adjustment assembly will alter the present offset $P_1$ by an amount $P_2$ equal to the bias B. The new position of the upper and lower printing couple phase of printing unit 14 with respect to the reference printing unit 16 is equal to $P_1+B$. It will be appreciated that B may be a negative number. A positive B represents an advance of the printing unit-to-unit phase and a negative number represents the retarding of the printing unit-to-unit phase. The upper circumferential adjustment assembly 38 rotates the upper printing plate by rotating the upper printing plate cylinder 22 by an amount $U_2$ which is equal to $U_1+\Delta U-B$. The lower circumferential adjustment assembly 40 rotates the lower printing plate by rotating the lower printing plate cylinder 30 by an amount $L_2=L_1+\Delta L-B$. The new position for the total displacement of the upper printing plate with respect to its associated upper blanket is a different value than prior to the rotation. Therefore, $U_1$ is updated in step 176 according to the equation $U_1=2U_1+\Delta U-B$. The amount of displacement of the lower printing plate is updated because of the circumferential change according to the equation $L_1=2L_1+\Delta L-B$. Those skilled in the art will appreciate in step 176 that the $U_1$ and $L_1$ on the left side of the equation are the new value of $U_1$ and $L_1$ and the $U_1$ and $L_1$ on the right side of the equation are the old $U_1$ and $L_1$ values used in the calculations in steps 168, 170, 172 and 174. After the $U_1$ and $L_1$ positions are updated in step 176, step 162 is repeated to continue monitoring of the print registration. If a registration change is needed in step 64, a new $\Delta U$ and $\Delta L$ is determined in step 166 and the calculations in steps 168, 170, 172 and 174 are made utilizing the updated $U_1$ and $L_1$ values and the new $\Delta U$ and $\Delta L$ values determined in step 166.

It will be appreciated that the unit-to-unit phaser adjustment assembly is utilized to perform a major part of the change to effect registration between units while the upper and lower circumferential adjustment assemblies are utilized to make the remainder of the changes within the printing unit being adjusted. It is possible in the bias equations to let $(L_1+\Delta L-U_1-\Delta U)/2$ be equal to k. The bias equations can also be determined by allowing k to equal 0 and having the bias equation in step 170 be $B=U_1+\Delta U$, and the bias equation in step 172 to be $B=L_1+\Delta L$. By performing the bias equations as such, i.e., letting $k=0$, means that either the upper printing plate or the lower printing plate will be no further misregistered by step 174 since only one circumferential adjustment will be made within the unit. If the answer in step 168 were yes, then $U_2$ in step 174 would be equal to 0. Thus, $L_2$ for the lower circumferential adjustment assembly would be the only one adjusted for registration. Similarly, if the determination in step 168 was no, then $L_2$ in step 174 would be equal to 0 and $U_2$ would be the only circumferential change made. Performing the bias calculations according to the equation in the flow chart of FIG. 7, i.e., $k=(L_1+\Delta L-U_1-\Delta U)/2$, means that the circumferential adjustment change needed to register a printing unit with a reference printing unit will be equally shared by the upper and the lower printing plates. In most cases, this would be the desirable method of registering a printing unit with a reference printing unit.

The initial $U_1$, $L_1$ and $P_1$ positions inputted in step 160 are determined by the potentiometers 144, 148 and 146, respectively. It is possible to determine the cylinder position by counting pulses given to the motors by the controller 42. It is preferable that motors 54, 140 and 142 are synchronous motors. Knowing that the motor shaft rotates through a specific angle for a given number of pulses, the positions of the cylinders can be calculated from an initial known position. It is also possible to have mechanical zero indicators that will produce a signal when the cylinder is rotated to a position tripping the zero indicator. Motor pulses can be counted after a zero indication is received and thereby determine the cylinder positions.

This invention has been described with reference to preferred embodiments. Modifications and alterations may occur to others upon reading and understanding the specification. It is my intention to include all such modifications and alterations insofar as they come within the scope of the appended claims or the equivalent thereof.

What is claimed is:

1. A method for registering a perfecting offset printing unit to a reference perfecting offset printing unit while minimizing displacement between associated non-print gap areas, both printing units acting in succession on a web and each unit having an upper printing plate disposed around an upper print cylinder and an upper blanket disposed around an upper blanket cylinder, such combination defining an upper printing couple and each unit having a lower printing plate disposed around a lower print cylinder and a lower blanket disposed around a lower blanket cylinder, such combination defining a lower printing couple, said method comprising the steps of:

(a) monitoring the circumferential position of said upper printing plate and said lower printing plate of said unit with respect to their associated blankets;

(b) monitoring print registration between said unit and said reference unit;

(c) determining a printing position change needed for each printing couple of said unit to effect registration with said reference unit;

(d) determining circumferential bias responsive to said determined printing position changes needed and responsive to said monitored circumferential position of said printing plates of said unit;

(e) rotating said printing couples of said unit responsive to said determined circumferential bias; and (f) circumferentially adjusting the relative position of the printing plate and blanket of at least one of said printing couples of said unit responsive to said determined circumferential bias, to the monitored printing plate position of said at least one printing couple being adjusted and to the determined printing plate position change needed for said at least one printing couple being adjusted.

2. The method of claim 1 wherein said upper and lower printing couples are rotated and said at least one printing plate is circumferentially adjusted with respect to its associated blanket simultaneously.

3. A method for registering a perfecting offset printing unit to a reference perfecting offset printing unit while minimizing displacement between associated non-print gap areas, both printing units acting in succession on a web and each unit having an upper printing plate disposed around an upper printing cylinder and an upper blanket disposed around an upper blanket cylinder, such combination defining an upper printing couple and each unit having a lower printing plate disposed around a lower printing cylinder and a lower blanket disposed around a lower blanket cylinder, such combination defining a lower printing couple, said perfecting offset printing unit having a unit-to-unit phaser adjustment assembly that adjusts both the upper and lower printing couple with respect to said reference perfecting offset printing unit and having an upper circumferential adjustment assembly for adjusting the relative position of said upper printing plate with said upper blanket of said perfecting offset printing unit and a lower circumferential adjustment assembly for adjusting the relative position of said lower printing plate with said lower blanket of said perfecting offset printing unit, said method comprising the steps of:

(a) monitoring the circumferential position of said upper printing plate and said lower printing plate of said perfecting offset printing unit with respect to their associated blankets;

(b) monitoring print registration between said perfecting offset printing unit and said reference perfecting offset printing unit;

(c) determining a circumferential change needed to effect registration of said upper and lower printing couples of said perfecting offset printing unit with said reference perfecting offset printing unit;

(d) adding the determined circumferential changes needed for the upper and lower printing couples to effect registration respectively to the monitored circumferential position of the upper printing plate and the lower printing plate of said perfecting offset printing unit;

(e) establishing a circumferential bias value equal to a numerical value of the smallest absolute value between the circumferential change needed to effect registration for the upper printing plate added to the monitored circumferential position of the upper printing plate and the circumferential change needed to effect registration for the lower printing plate added to the monitored circumferential position of the lower printing plate;

(f) adjusting the unit-to-unit phaser adjustment assembly of said perfecting offset printing unit by an amount equal to the established circumferential bias value;

(g) adjusting the circumferential adjustment assembly for the upper printing plate by an amount equal to the circumferential change needed to effect registration for the upper printing plate added to the monitored circumferential position of the upper printing plate less the established circumferential bias value; and (h) adjusting the circumferential adjustment assembly for the lower printing plate by an amount equal to the circumferential change needed to effect registration for the lower plate added to the monitored circumferential position of the lower printing plate less the established circumferential bias value.

4. A method for registering a perfecting offset printing unit to a reference perfecting offset printing unit, both acting in succession on a web and each unit having an upper printing plate disposed around an upper print cylinder and an upper blanket disposed around an upper blanket cylinder, such combination defining an upper printing couple and each unit having a lower printing plate disposed around a lower print cylinder and a lower blanket disposed around a lower blanket cylinder, such combination defining a lower printing couple, said method comprising the steps of:

(a) determining the circumferential position $U_1$ of the upper printing plate of said unit with respect to its associated upper blanket of said unit;

(b) determining the circumferential position $L_1$ of the lower printing plate of said unit with respect to its associated lower blanket of said unit;

(c) monitoring print registration between said unit and said reference unit;

(d) determining $\Delta U$ and $\Delta L$ changes needed to effect registration of said unit with said reference unit, where $\Delta U$ is the amount of shift needed to register the upper printing couple of said unit with the upper printing couple of said reference unit and where $\Delta L$ is the amount of shift needed to register the bottom printing couple of said unit with the bottom printing couple of said reference unit;

(e) determining circumferential bias B according to the equations:

$$\text{when } |U_1+\Delta U| \geqq |L_1+\Delta L|,$$

$$\text{then } B=U_1+\Delta U$$

$$\text{when } |U_1+\Delta U| > |L_1+\Delta L|,$$

$$\text{then } B=L_1+\Delta L;$$

(f) rotating the upper printing couple and the lower printing couple of said unit by an amount sufficient to effect a circumferential displacement from its present position by an amount equal to B;

(g) rotating the upper printing plate of said unit by an amount $U_2$ sufficient to effect a circumferential displacement equal to $U_1+\Delta U-B$ if $U_2 \neq 0$; and (h) rotating the lower printing plate of said unit by an amount $L_2$ sufficient to effect a circumferential displacement equal to $L_1+\Delta L-B$ if $L_2 \neq 0$.

5. The method of claim 4 further including the steps of:

(a) updating the value of $U_1$ according to the equation $$U_1=2U_1+\Delta U-B;$$

(b) updating the value of $L_1$ according to the equation $$L_1=2L_1+\Delta L-B;$$

and (c) repeating steps c through h.

6. A method for registering a perfecting offset printing unit to a reference perfecting offset printing unit, both acting in succession on a web and each unit having an upper printing plate disposed around an upper print cylinder and an upper blanket disposed around an upper blanket cylinder, such combination defining an upper printing couple and each unit having a lower printing plate disposed around a lower print cylinder and a lower blanket disposed around a lower blanket cylinder, such combination defining a lower printing couple, said method comprising the steps of:

(a) determining the circumferential position $U_1$ of the upper printing plate of said unit with respect to its associated upper blanket of said unit;

(b) determining the circumferential position $L_1$ of the lower printing plate of said unit with respect to its associated lower blanket of said unit;

(c) monitoring print registration between said unit and said reference unit;

(d) determining $\Delta U$ and $\Delta L$ changes needed to effect registration of said unit with said reference unit, where $\Delta U$ is the amount of shift needed to register the upper printing couple of said unit with the upper printing couple of said reference unit and where $\Delta L$ is the amount of shift needed to register the bottom printing couple of said unit with the bottom printing couple of said reference unit;

(e) determining circumferential bias B according to the equations:

$$\text{When } |U_1 + \Delta U| \leqq |L_1 + \Delta L|, \text{ Then } B = U_1 + \Delta U + k,$$

$$\text{where } k = \frac{L_1 + \Delta L - U_1 - \Delta U}{2}$$

$$\text{When } |U_1 + \Delta U| > |L_1 + \Delta L|, \text{ Then } B = L_1 + \Delta L - k,$$

$$\text{where } k = \frac{L_1 + \Delta L - U_1 - \Delta U}{2};$$

(f) rotating the upper printing couple and the lower printing couple of said unit by an amount sufficient to effect a circumferential displacement from their present position by an amount equal to B;

(g) rotating the upper printing plate of said unit by an amount $U_2$ sufficient to effect a circumferential displacement equal to $U_1+\Delta U-B$ if $U_2 \neq 0$; and (h) rotating the lower printing plate of said unit by an amount $L_2$ sufficient to effect a circumferential displacement equal to $L_1+\Delta L-B$ if $L_2 \neq 0$.

7. An apparatus for registering a perfecting offset printing unit to a reference perfecting offset printing unit while minimizing displacement between associated non-print gap areas, both printing units acting in succession on a web and each unit having an upper printing plate disposed around an upper print cylinder and an upper blanket disposed around an upper blanket cylinder, such combination defining an upper printing couple and each unit having a lower printing plate disposed around a lower print cylinder and a lower blanket disposed around a lower blanket cylinder, such combination defining a lower printing couple, said apparatus comprising:

unit-to-unit phaser adjustment means operatively connected to said unit for circumferentially adjusting the upper and lower printing couples of said unit with respect to said reference unit;

upper circumferential adjustment means operatively connected to said upper printing plate of said unit for circumferentially adjusting the relative position between the upper printing plate of said unit and said upper blanket of said unit;

lower circumferential adjustment means operatively connected to said lower printing plate of said unit for circumferentially adjusting the relative position between the lower printing plate of said unit and said lower blanket of said unit;

first monitoring means for monitoring circumferential position $U_1$ of said upper printing plate of said unit with respect to its associated upper blanket and circumferential position $L_1$ of said lower printing plate of said unit with respect to its associated lower blanket;

second monitoring means for monitoring registration between said unit and said reference unit;

determining means for determining a printing change $\Delta U$ needed for said upper printing couple of said unit and a printing change $\Delta L$ needed for said lower printing couple of said unit to effect registration with said reference unit;

control means operatively connected to said unit-to-unit phaser adjustment means and said circumferential adjustment means for determining a circumferential bias B responsive to said determined printing changes needed and responsive to said monitored circumferential position of said printing plates of said unit, for controlling said unit-to-unit phaser adjustment means to rotate both said upper and lower printing couples of said unit responsive to said determined bias B and for controlling said upper and lower circumferential adjustment means to circumferentially adjust the relative position of the printing plate and blanket of at least one printing couples of said unit responsive to said bias B, to the monitored circumferential position of the printing plate of said at least one printing couple being adjusted and to the determined printing change needed for said at least one printing couple being adjusted.

8. The apparatus of claim 7 wherein said control means determines bias B according to the equations when $|U_1+\Delta U| \geqq |L_1+\Delta L|$, then $B=U_1+\Delta U$ and when $|U_1+\Delta U| > |L_1+\Delta L|$, then $B=L_1+\Delta L$.

9. The apparatus of claim 8 wherein said unit-to-unit phaser adjustment means rotates said printing couples by an amount to effect a circumferential displacement equal to B from their present position.

10. The apparatus of claim 9 wherein said upper printing plate of said unit is rotated by an amount equal to $U_2=U_1+\Delta U-B$ when $U_2 \neq 0$ and said lower printing plate of said unit is rotated by an amount equal to $L_2=L_1+\Delta L-B$ when $L_2 \neq 0$.

11. The apparatus of claim 10 wherein said control means updates the values of $U_1$ and $L_1$ after rotation to effect registration according to the equations:

$U_1=2U_1+\Delta U-B$ and $L_1=2L_1+\Delta L-B$.

12. The apparatus of claim 7 wherein said control means determines bias B according to the equations:

when $|U_1 + \Delta U| \leqq |L_1 + \Delta L|$,
then $B = U_1 + \Delta U + k$, where $k = \dfrac{L_1 + \Delta L - U_1 - \Delta U}{2}$ when $|U_1 + \Delta U| > |L_1 + \Delta L|$,
then $B = L_1 + \Delta L - k$, where $k = \dfrac{L_1 + \Delta L - U_1 - \Delta U}{2}$.

* * * * *